US006905226B2

(12) United States Patent
Tickner et al.

(10) Patent No.: US 6,905,226 B2
(45) Date of Patent: Jun. 14, 2005

(54) COMPACT FLUORESCENT LIGHT FIXTURE

(76) Inventors: Jerold A. Tickner, 11420 W. Ratcliffe, Littleton, CO (US) 80127; Donald J. Booty, Jr., 5522 E. Dusty Wren Dr., Cave Creek, AZ (US) 85331

( * ) Notice: Subject to any disclaimer, the term of this patent is extended or adjusted under 35 U.S.C. 154(b) by 11 days.

(21) Appl. No.: 10/634,644

(22) Filed: Aug. 5, 2003

(65) Prior Publication Data

US 2005/0030753 A1 Feb. 10, 2005

(51) Int. Cl.[7] ..... F21V 7/04

(52) U.S. Cl. ..... 362/235; 362/225; 362/245; 362/350

(58) Field of Search ..... 362/147, 216, 362/221, 236, 240, 241, 243, 244, 246, 249, 362/260, 263, 296, 297, 310, 317, 326–329, 362/334, 347, 350, 255, 256, 453, 454

(56) References Cited

U.S. PATENT DOCUMENTS

| | | | | | |
|---|---|---|---|---|---|
| 4,947,197 | A * | 8/1990 | Smart et al. | ..... | 396/390 |
| 5,174,646 | A * | 12/1992 | Siminovitch et al. | ..... | 362/218 |
| 5,197,798 | A * | 3/1993 | Tickner | ..... | 362/235 |
| 5,377,086 | A * | 12/1994 | Tickner | ..... | 362/235 |
| 5,523,931 | A * | 6/1996 | Kassay et al. | ..... | 362/235 |
| 5,528,473 | A * | 6/1996 | Kassay et al. | ..... | 362/247 |
| 5,651,609 | A * | 7/1997 | Pelton et al. | ..... | 362/294 |
| 6,447,147 | B1 * | 9/2002 | Kramer et al. | ..... | 362/297 |

* cited by examiner

*Primary Examiner*—Stephen Husar
*Assistant Examiner*—Hargobind S. Sawhney
(74) *Attorney, Agent, or Firm*—Tod R. Nissle, P.C.

(57) ABSTRACT

A high efficiency heat-dissipating dome lamp utilizes convex centralized optics and tiered venting to house concurrently inwardly canted compact fluorescent lights, ballast for the lights, and an emergency ballast system.

3 Claims, 12 Drawing Sheets

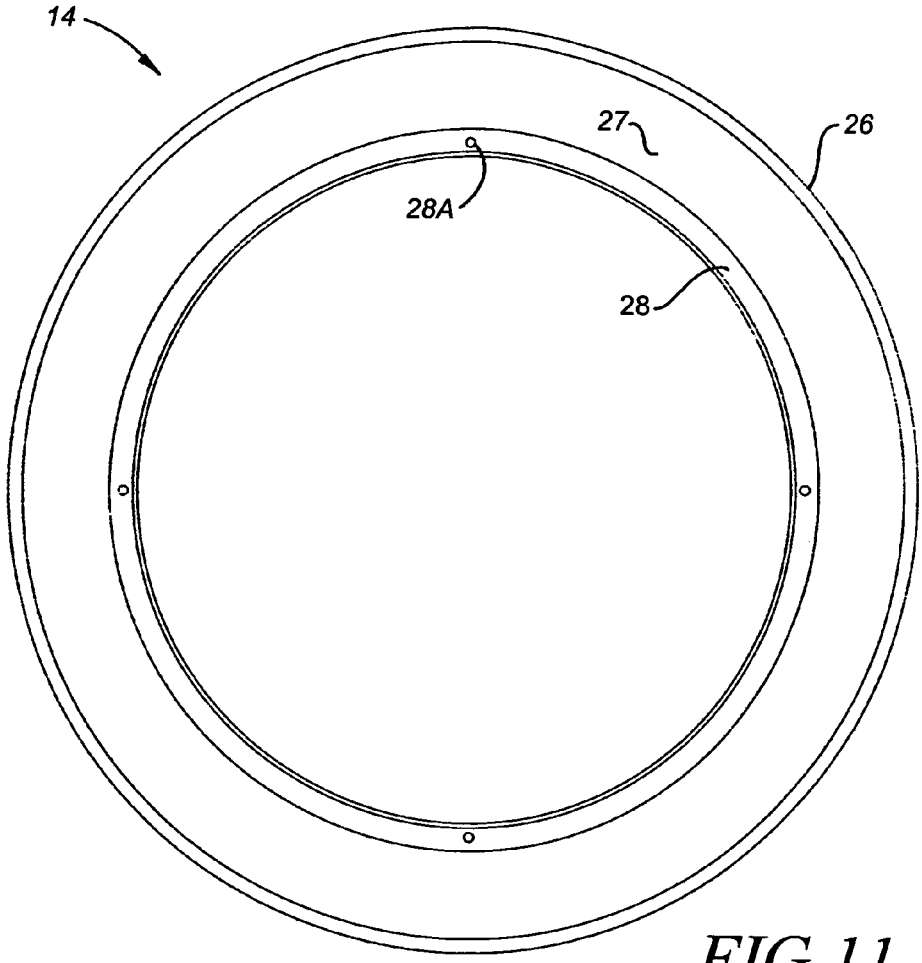
FIG.11
FIG.12
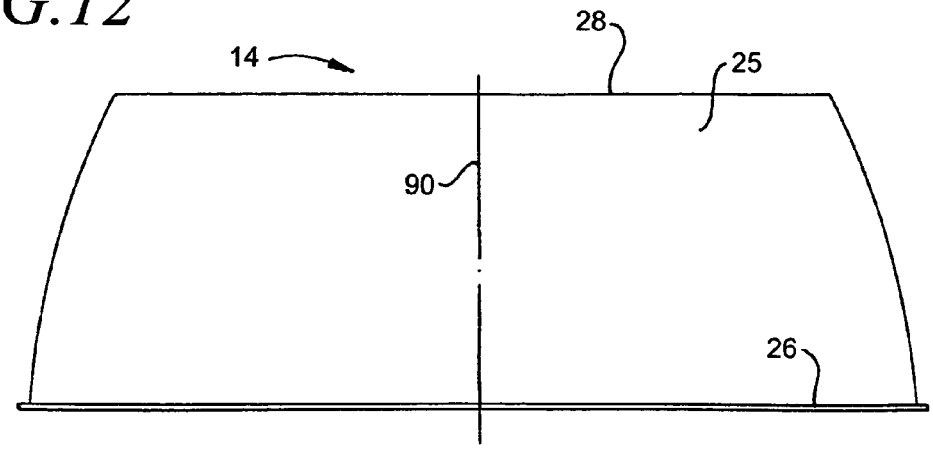

COMPACT FLUORESCENT LIGHT FIXTURE

This invention relates to lighting fixtures.

More particularly, this invention relates to lighting fixtures for compact fluorescent lights.

Lamp fixtures for compact fluorescent lights are well known. See my U.S. Pat. No. 5,377,086. Such lamps include compact fluorescent lights that are canted outwardly toward the concave walls of the lamp fixture. Heat dissipation is a particular problem for such lamp fixtures, particularly when amalgam compact fluorescent lights are utilized. The amalgam in compact fluorescent lights is provided for the purpose of providing a relatively stable, constant light output over a temperature range of approximately eighty degrees Centigrade to one-hundred and twenty degrees Centigrade. If the operating temperature of an amalgam compact fluorescent light exceeds about one-hundred and twenty degrees Centigrade, then the light output of the light is significantly degraded. Amalgam compact fluorescent lamps operate most efficiently at an operating temperature of about eighty degrees Centigrade. At operating temperatures in the range of eighty-one to one hundred and twenty degrees Centigrade, the operating efficiency of the lamps decreases by up to about 15%.

Conventional lamp fixtures of the type illustrated in U.S. Pat. No. 5,377,086 typically are constructed to operate with forty-two watt compact fluorescent lights. If however, such light fixtures could operate with fifty-seven watt compact fluorescent lights, this would be a distinct advantage because a light fixture with eight fifty-seven watt compact fluorescent lights produces about 34,400 lumens, which is on the order of the 34,000 to 36,000 lumens produced by metal halide lamp fixtures. Compact fluorescent lights are much more efficient than metal halide lamp fixtures. A particular problem with attempting to use fifty-seven watt compact fluorescent lights in a conventional lamp fixture of the type shown in U.S. Pat. No. 5,377,086 is that the fixture typically can not successfully dissipate enough heat to maintain the operating temperature of the lights at less than about one hundred and twenty degrees Centigrade.

Accordingly, it would be highly desirable to provide an improved lamp fixture that could utilize fifty-seven watt compact fluorescent lights, and even one hundred and twenty watt compact fluorescent lights, while maintaining the operating temperature of the lights at less than about one hundred and twenty degrees Centigrade.

Therefore, it is a principal object of the invention to provide an improved lighting apparatus and system.

Another object of the invention is to provide an improved lamp fixture in which high wattage compact fluorescent lights can be operated at desired optimal operating temperatures.

These and other, further and more specific objects and advantages of the invention will be apparent to those of skill in the art from the following detailed description thereof, taken in conjunction with the drawings, in which:

FIG. 11 is a bottom view illustrating the outer optic member of the lamp fixture of the invention;

FIG. 12 is a side view illustrating the outer optic member of the lamp fixture of the invention;

Briefly, in accordance with the invention, I provide an improved lamp fixture. The lamp fixture includes a housing. The housing includes a base end of a first size; a light-emitting end of a second size larger than the first size; a center line extending from the center of the base end to the center of the light emitting end; and, an outer optical surface extending intermediate the base end and the light-emitting end. The light fixture also includes a convex inner optical surface inside the housing extending around the center line; and, a lamp support inside the housing for supporting a plurality of compact fluorescent lights displaced about the center line and the inner optical surface including a plurality of lamp supports angled such that compact fluorescent lights supported thereby extend inwardly toward the light-emitting end at an angle toward the center line, toward the inner optical surface, and away from the outer optical surface of said housing.

In another embodiment of the invention, I provide an improved lamp fixture including a dome-shaped housing having a base end of a first size; a light-emitting end of a second size larger than the first size; a center line extending from the center of the base end to the center of the light emitting end; and, an inner surface extending intermediate the base end and the light-emitting end. The lamp fixture also includes a light support inside the housing for supporting a plurality of compact fluorescent lights; ballast mounted inside the dome-shaped housing for each of the compact fluorescent lights; and, an emergency ballast system mounted inside the dome-shaped housing and including a ballast and a battery.

In a further embodiment of the invention, I provide an improved lamp fixture. The lamp fixture includes a dome-shaped housing. The housing has a base end of a first size;

a light-emitting end of a second size larger than the first size; a center line extending from the center of the base end to the center of the light emitting end; and, an outer optical surface extending intermediate the base end and the light-emitting end. The lamp fixture also includes a light support inside said housing for supporting a plurality of compact fluorescent lights; ballast mounted inside the dome-shaped housing for each of the compact fluorescent lights; and, first vents formed in the lamp fixture such that heat generated by the compact fluorescent lights rises upwardly through the vents past the ballast.

Figure 1:
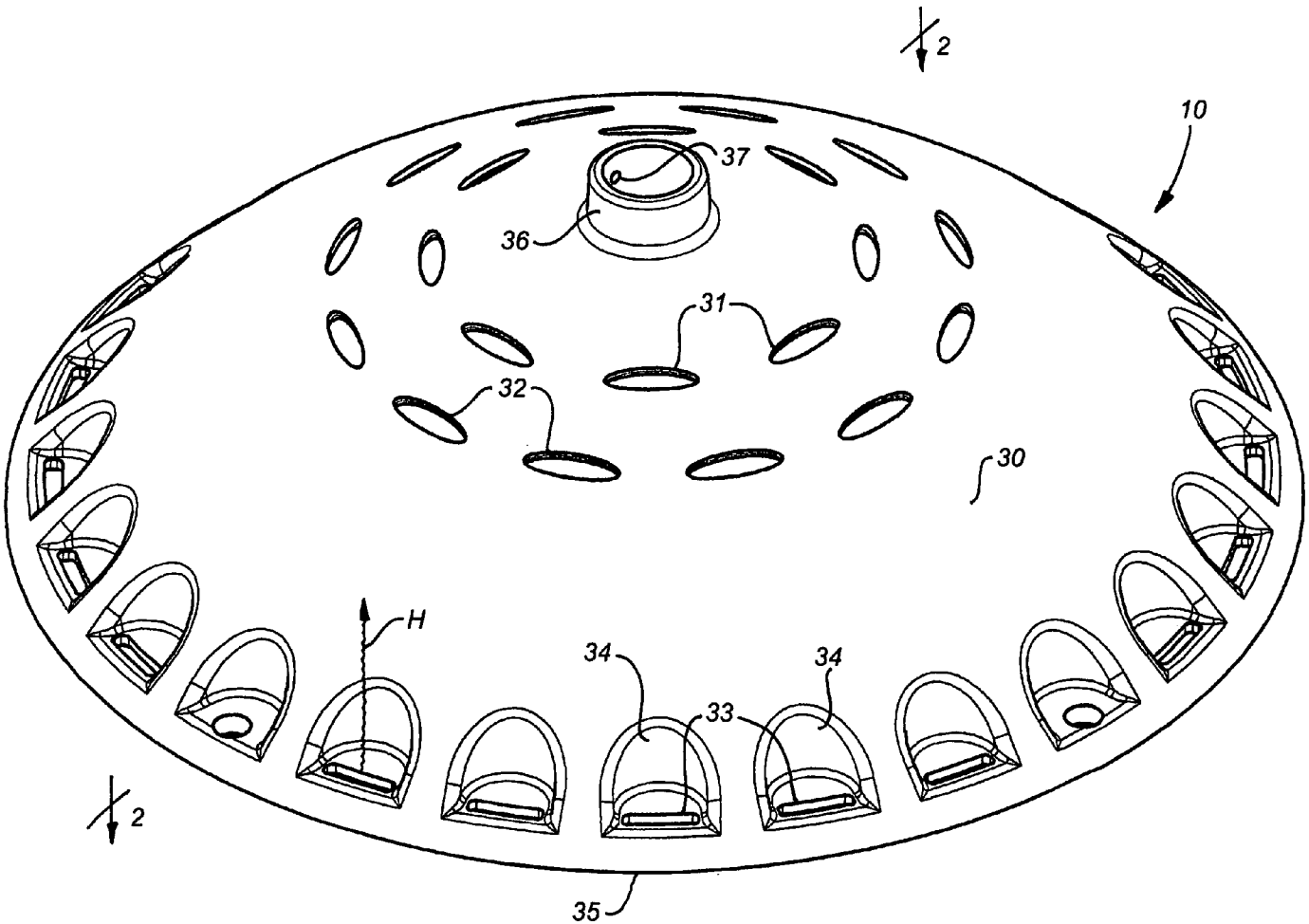
FIG. 1 is a perspective view illustrating the top of the lamp fixture of the invention.
Figure 2:
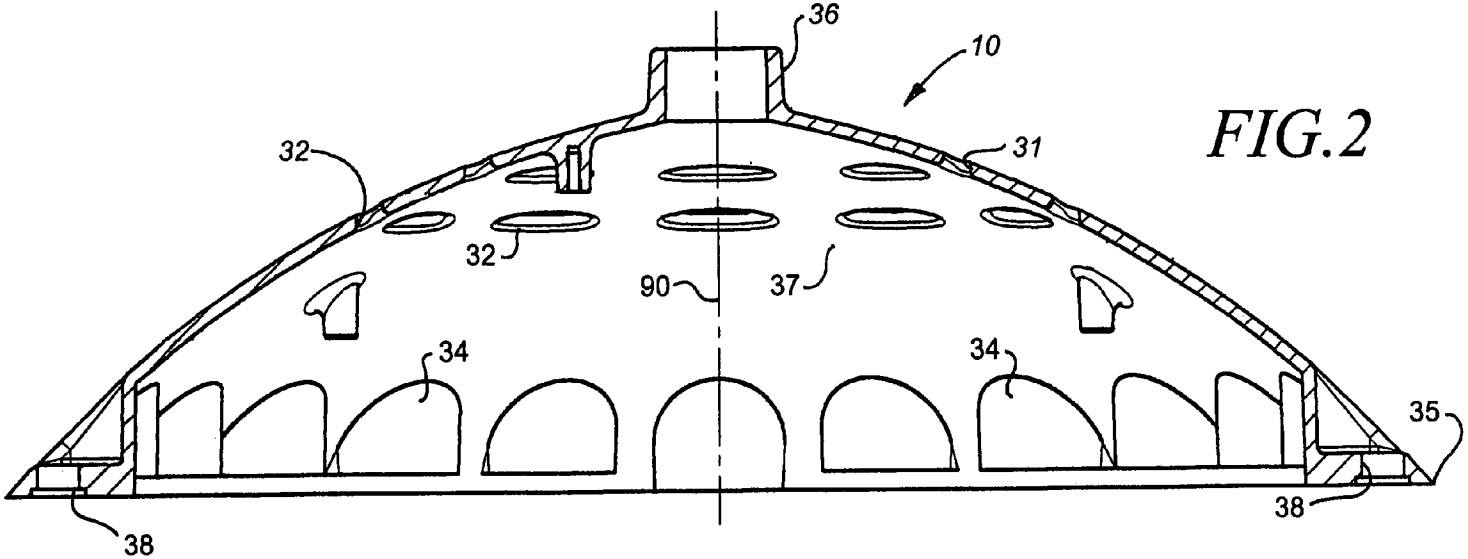
FIG. 2 is a section view of the top of FIG. 1 taken along section line 2—2 thereof and illustrating additional construction features thereof.

Turning now the drawings, which depict the presently preferred embodiments of the invention for the purpose of illustration thereof, and not by way of limitation of the invention, and in which like characters refer to corresponding elements throughout the several views, FIGS. 1 and 2 illustrate the top 10 of the lamp fixture of the invention. The lamp fixture also includes ballast support 11, light support 12, inner optic member 13, and outer optic member 14.

The outer arcuate surface 30 of top 10, the outer arcuate surface 40 of ballast support 11, and the outer arcuate surface 25 of outer optic light-emitting member 14 collectively define and comprise the presently preferred dome-shaped housing of the light fixture of the invention. The shape and dimension of the housing can vary as desired.

In FIGS. 1 and 2, top 10 includes hollow base end or sleeve 36 shaped and dimensioned to slidably receive an end of a conduit or pipe extending downwardly from the ceiling of a building structure. A set screw (not shown) is turned through internally threaded aperture 37 to secure the end of the conduit inside sleeve 36. The lamp fixture of the invention can be mounted in any desired orientation.

Arcuate outer surface 30 extends outwardly and downwardly from sleeve 36 to circular lip 35. Lip 35 circumscribes center line 90. Each point on lip 35 is equidistant from centerline 90. An inner ring of equally spaced vents 31 is formed through the center area of top 10. An outer ring of equally spaced vents 32 is also formed through the center area of top 10 and is concentric with the inner ring of vents and with cylindrical sleeve 36. A ring of equally spaced detents 34 is formed around the peripheral portion of top 10. Detents 34 facilitate the formation of a plurality of horizontally oriented equally spaced vents 33. Substantially all points on arcuate outer surface 30 are equidistant from inner surface 37. The size, shape, dimension, and placement of vents on top 10—as well as on other parts of the lamp fixture of the invention—can vary as desired. The current placement and configuration of vents is, however, preferred and important for reasons set forth below. Top 10 also includes apertures 38 for receiving externally threaded screws during assembly of the lamp fixture of the invention when top 10 is connected to ballast support 11.

Ballast support 11 is illustrated in FIGS. 3 to 6 and includes upper edge 54, lower edge 41, outer arcuate surface 40, inner arcuate surface 43, equally spaced detents 41, equally spaced horizontally oriented vents (i.e., openings) each formed through the floor of a detent 41, winged ballast receiving units 46, and apertures 49, 50, 51 for receiving externally threaded screws during attachment of support 11 to top 10.

Figure 4:
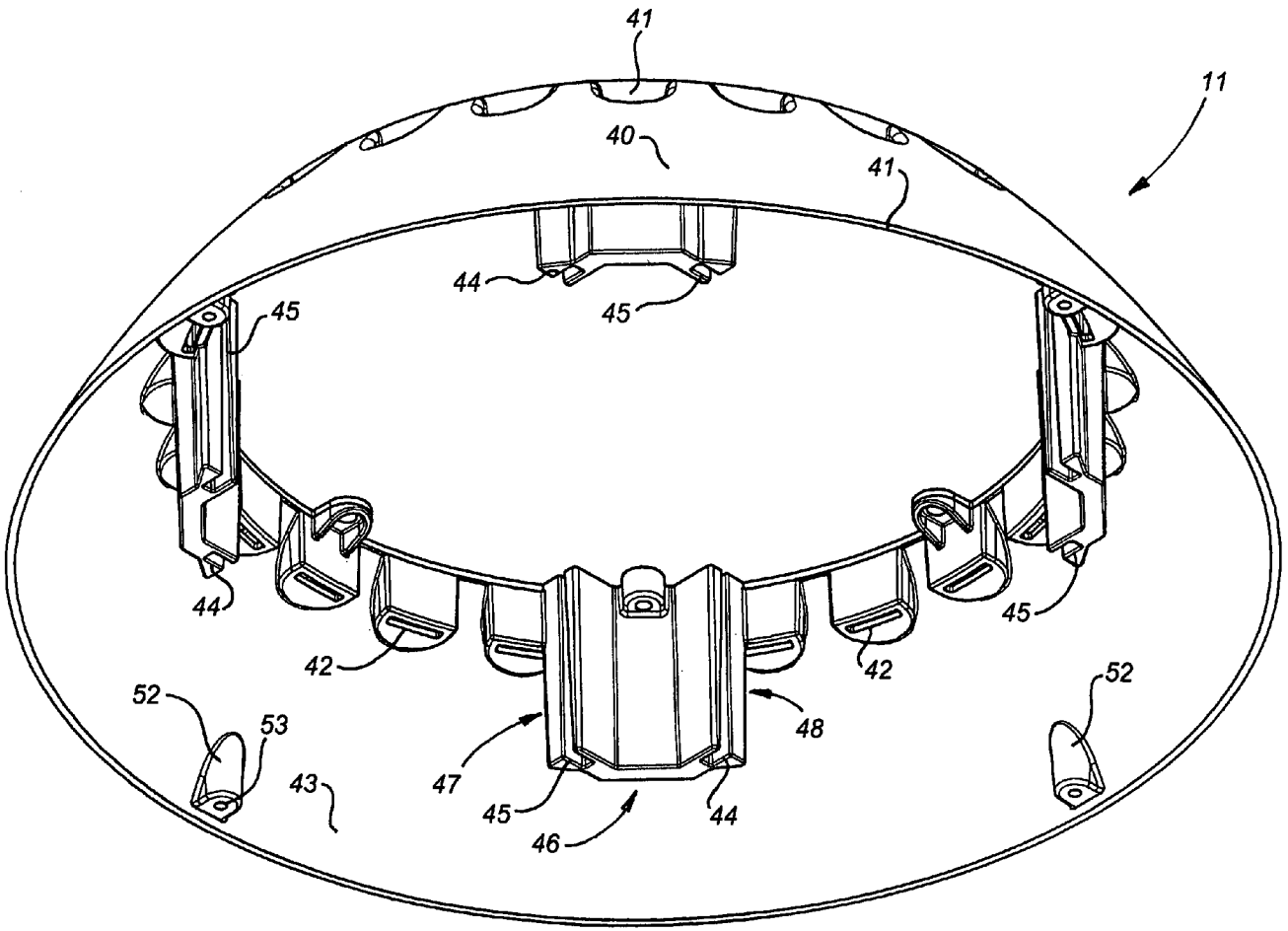
FIG. 4 is a bottom perspective view of the ballast support of FIG. 3 illustrating additional construction details thereof.
Figure 5:
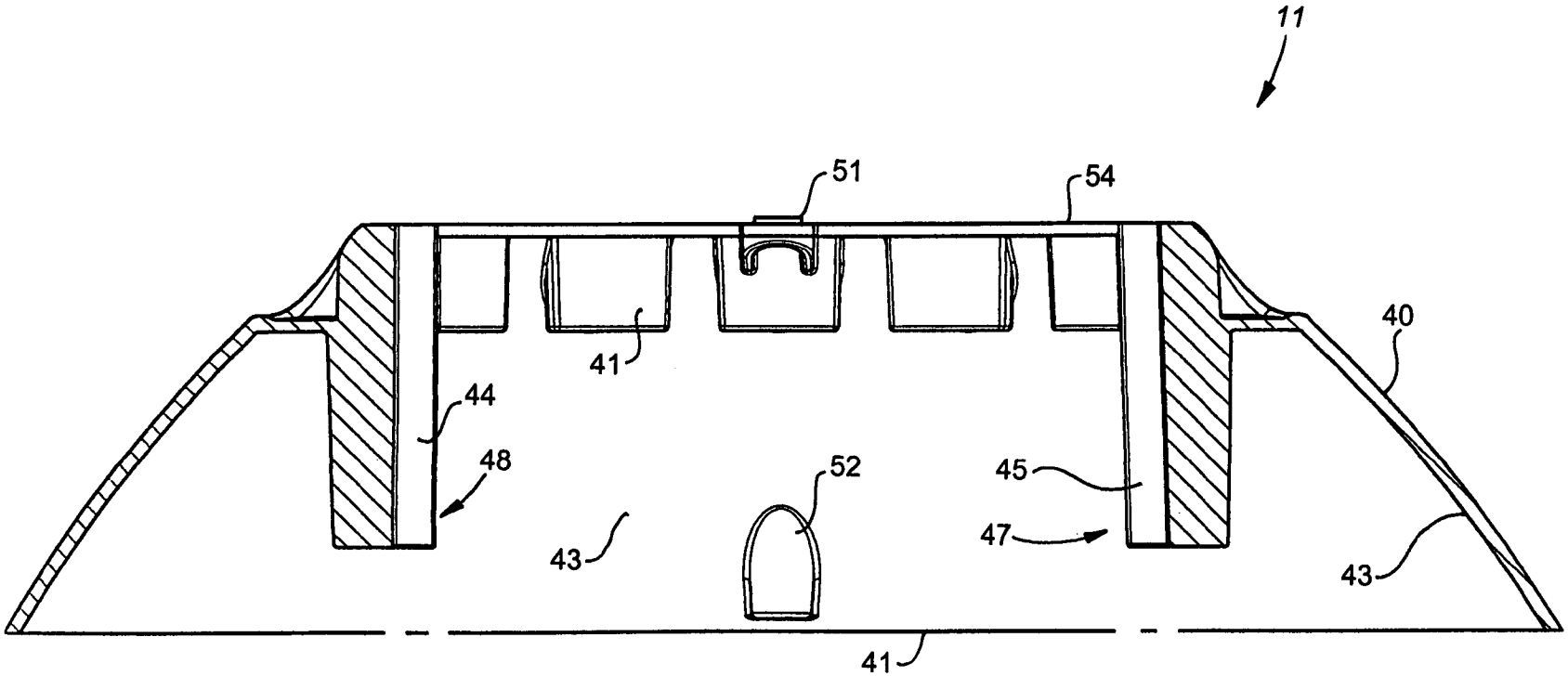
FIG. 5 is a section view of the ballast support of FIG. 3 taken along section lines 5—5 thereof and illustrating additional construction details thereof.
Figure 6:
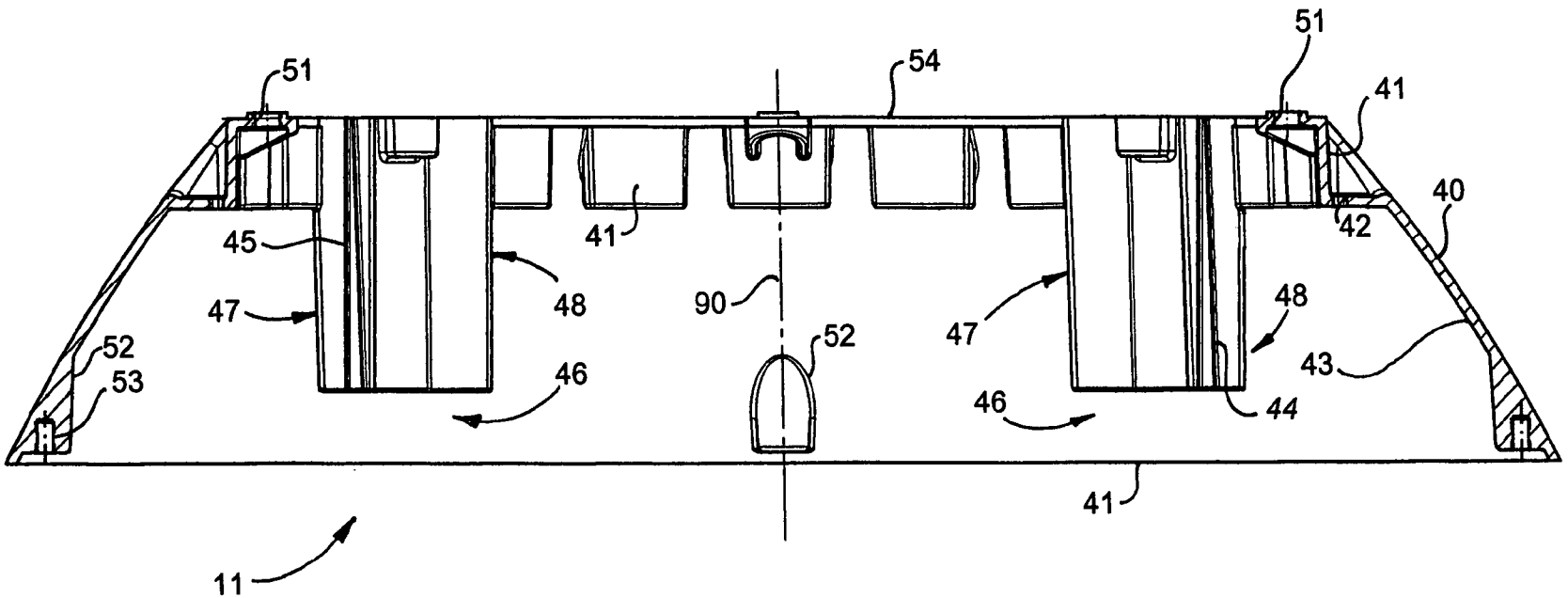
FIG. 6 is a section view of the ballast support of FIG. 3 taken along section lines 6—6 thereof and illustrating additional construction details thereof.
Figure 15:
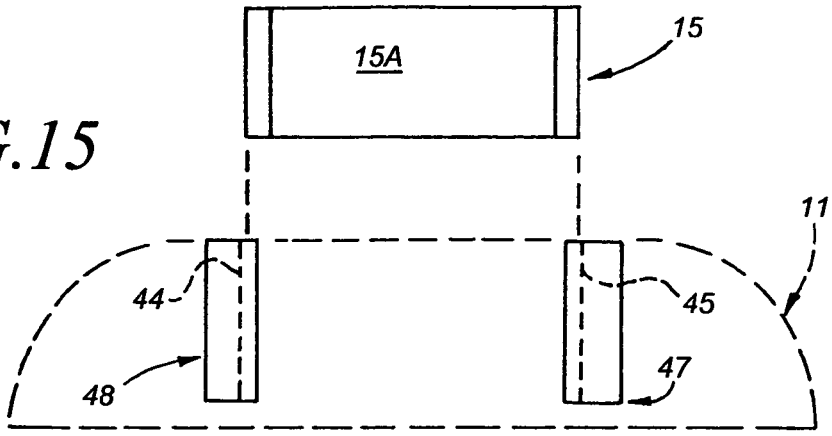
FIG. 15 is a side elevation view illustrating insertion of a ballast in the ballast support of the lamp fixture of the invention.
Figure 16:
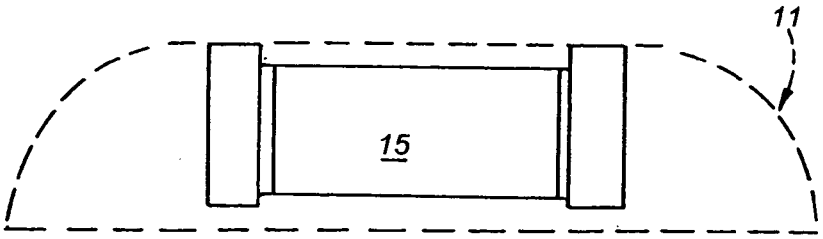
FIG. 16 is a side elevation view illustrating a ballast inserted in the ballast support of the lamp fixture of the invention; and, FIG. 17 is a side elevation section view illustrating insertion of the light sockets in the lamp support of the invention.

Each aperture 49 to 51 aligns with an aperture 38. Each ballast receiving unit 46 includes a pair of perpendicular wings 47 and 48. Each wing 48 has a vertically oriented slot 44 formed therein. Each wing 47 has a vertically oriented slot 45 formed therein. Each wing 47 is coplanar with, spaced apart from, and opposes a wing 48 in another unit 46. This enables a panel of ballast 15 to be slidably inserted in slots 44, 45 of an opposing pair 47—48 of wings in the manner illustrated in FIGS. 15 and 16. As can be seen in FIG. 4, ballast support 11 also includes a plurality of members 52 each including an aperture 53 for receiving a threaded screw during attachment of support 11 to support 12.

Figure 8:
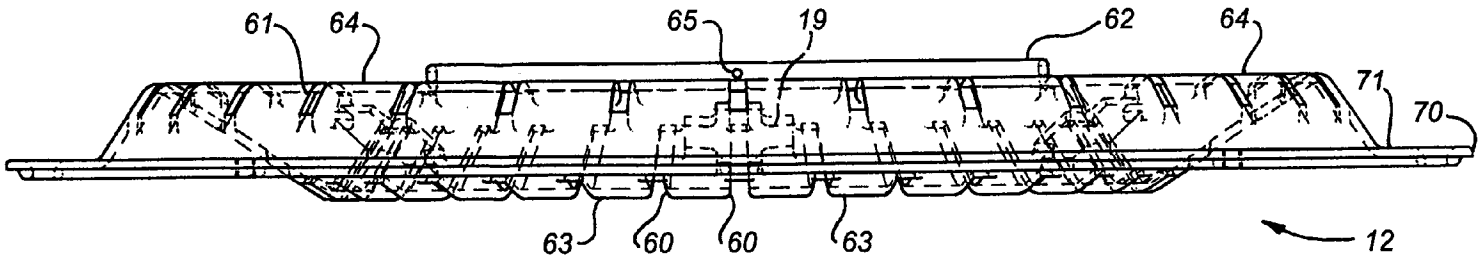
FIG. 8 is an inverted side view of the light support of FIG. 7 illustrating additional construction details thereof.
Figure 7:
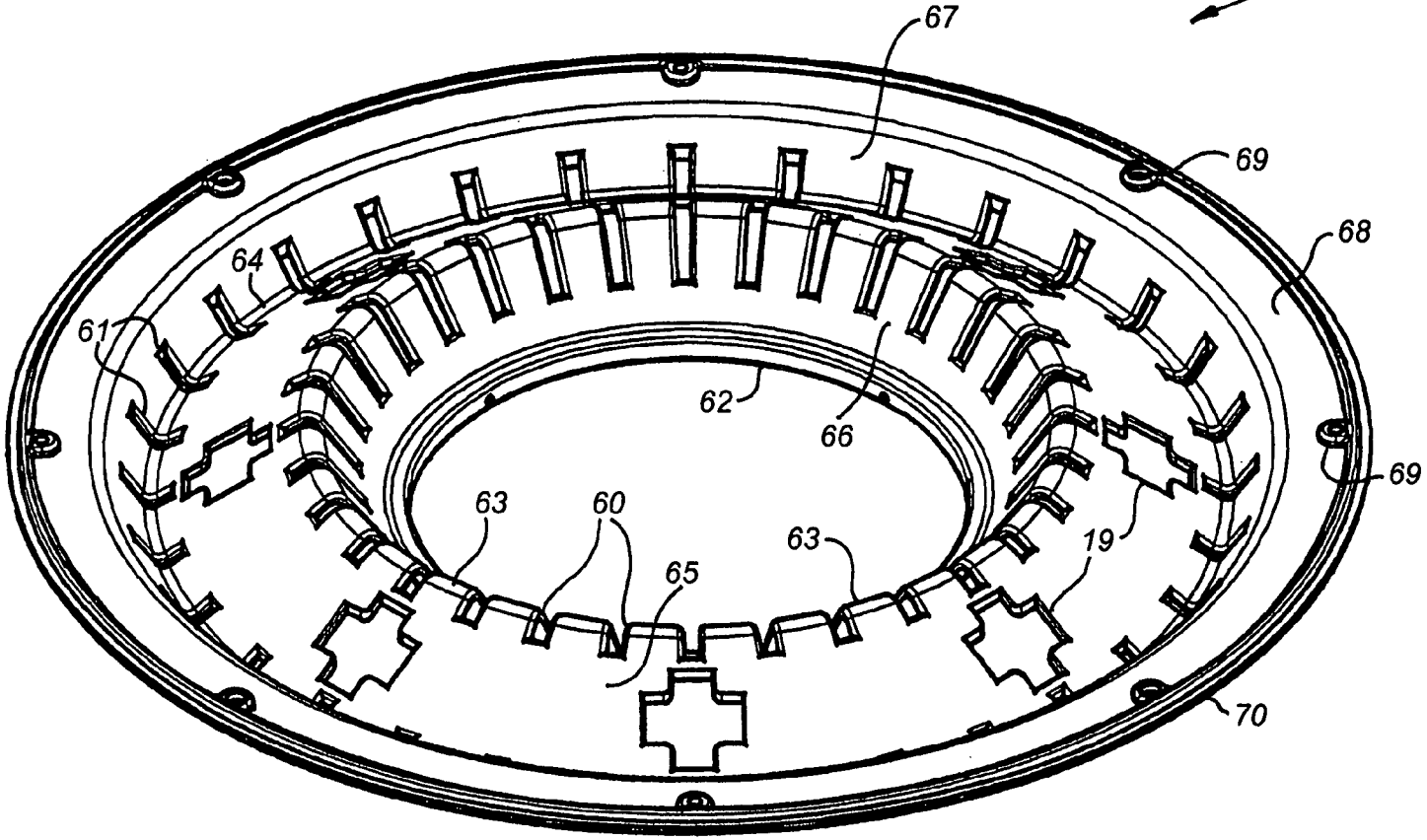
FIG. 7 is a top perspective view illustrating the light support of the lamp fixutre of the invention.

The light support 12 is illustrated n FIGS. 7 and 8 and includes eight (8) cross-shaped equally spaced openings 19 formed therethrough. The distance between each adjacent pair of openings 19 can vary as desired, but is presently greater than two inches, preferably three inches or more, and most preferably four inches or more. The distance between openings 19 is critical. As the distance increases, the amount of metal or other material that is between openings 19 and that comprises support 12 increases. Support 19 functions to conduct more heat away from a lamp seated in a socket in opening 19.

Figure 17:
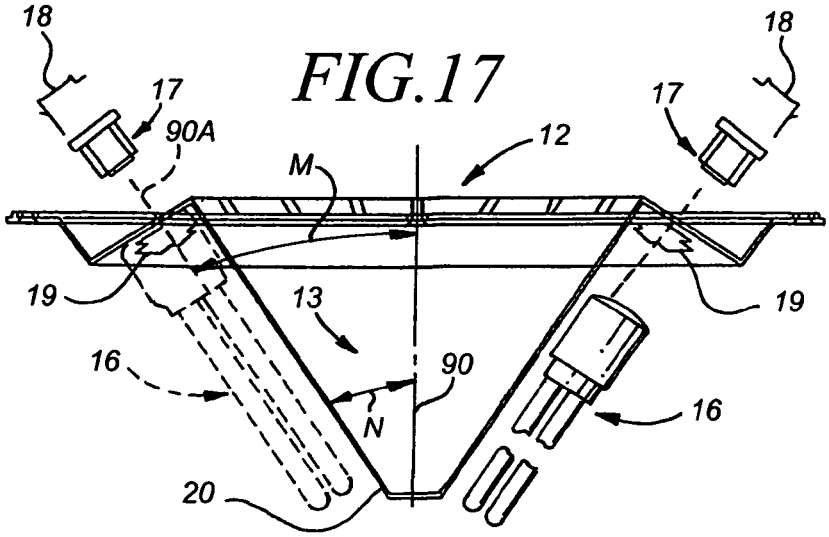

As the amount of metal increases, the heat sink capability of support 12 increases and tends to function to enable a light to operate at a lower temperature in the lamp fixture. As is illustrated in FIG. 17, a light socket 17 is mounted in each opening 19 in conventional fashion using a wire clip 18 or other means to secure socket 17 in opening 19. Each socket 17 is connected to a ballast 15 in conventional fashion. Electricity from a battery or other source is supplied to ballast 15 and its associated light 16 in conventional fashion. A compact fluorescent light 16 is inserted in and connected to a socket 17 in conventional fashion.

Light support 12 includes upper circular edge 70 and lower circular edge 62. A first inner circle of equally-spaced vents 60 is formed along a first inner ridge 63. A second outer circle of equally-spaced vents 61 is formed along a second outer ridge 64. The use of ridges 63 and 64 is preferred in the invention because, as will be described, it facilitates the upward flow of heat away from lights 16 mounted on support 12. Upper sloped surface 65 co-terminates at ridge 63 with upper sloped surface 66. Upper sloped surface 67 co-terminates at ridge 64 with upper sloped surface 65. Equally spaced apertures 69 can received threaded screws during the attachment of support 12 to support 11 and the attachment of support 12 to outer optic member 14.

Figure 9:
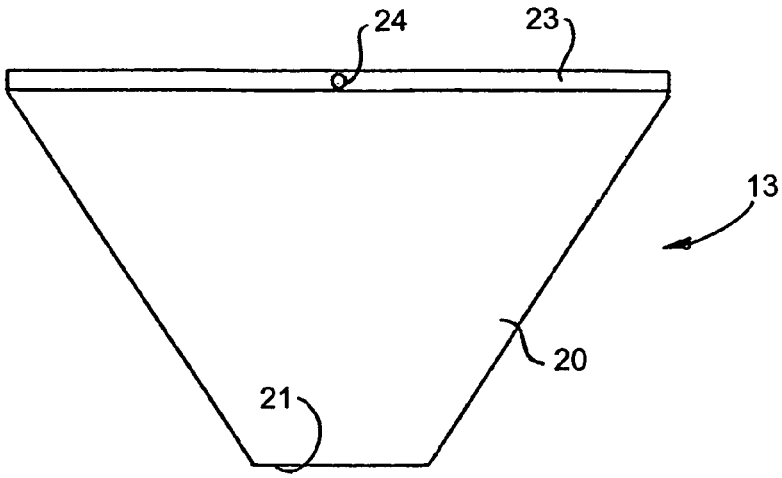
FIG. 9 is a side elevation view illustrating the inner optic member of the lamp fixture of the invention.
Figure 10:
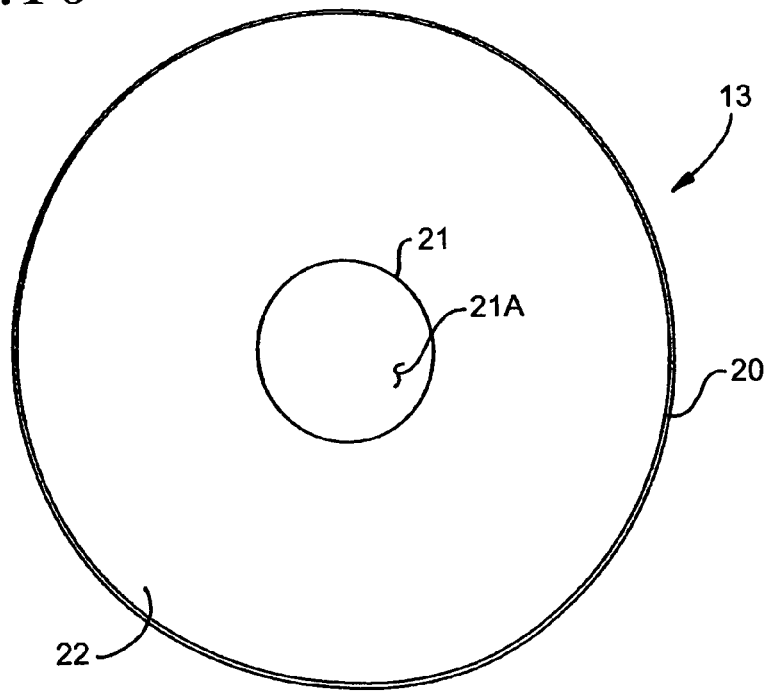
FIG. 10 is a bottom view of the optic member of FIG. 9.

Inner optic member 13 is illustrated in FIGS. 9 and 10 and includes outer conical convex surface 20, inner conical concave surface 22, upper cylindrical lip 23, and lower circular edge 21 circumscribing a circular opening 21A. Lip 23 is shaped and dimensioned to slide over circular edge 62 of light support 12. A set screw is turned through internally threaded aperture(s) 24 to secure member 13 on support 12. Surface 22 reflects light. Surface 22 can be finely polished to reflect light and radiant heat like a mirror, or, can be less finely polished or surfaced so that a smaller proportion of light is reflected.

Figure 13:
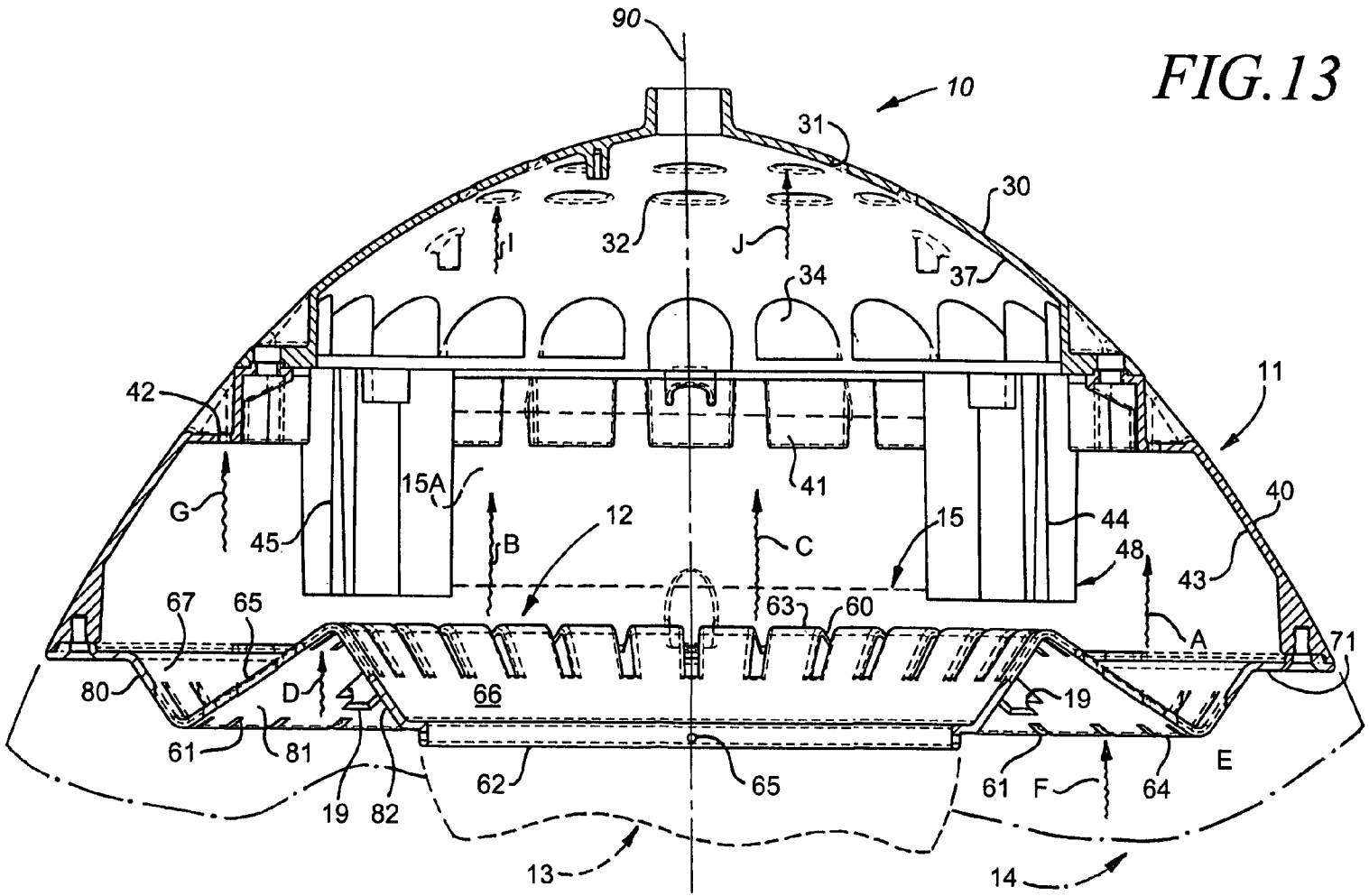
FIG. 13 is a side section view illustrating the top, the ballast support, the light support, the inner optic member, and the outer optic member of the lamp fixture of the invention assembled.
Figure 14:
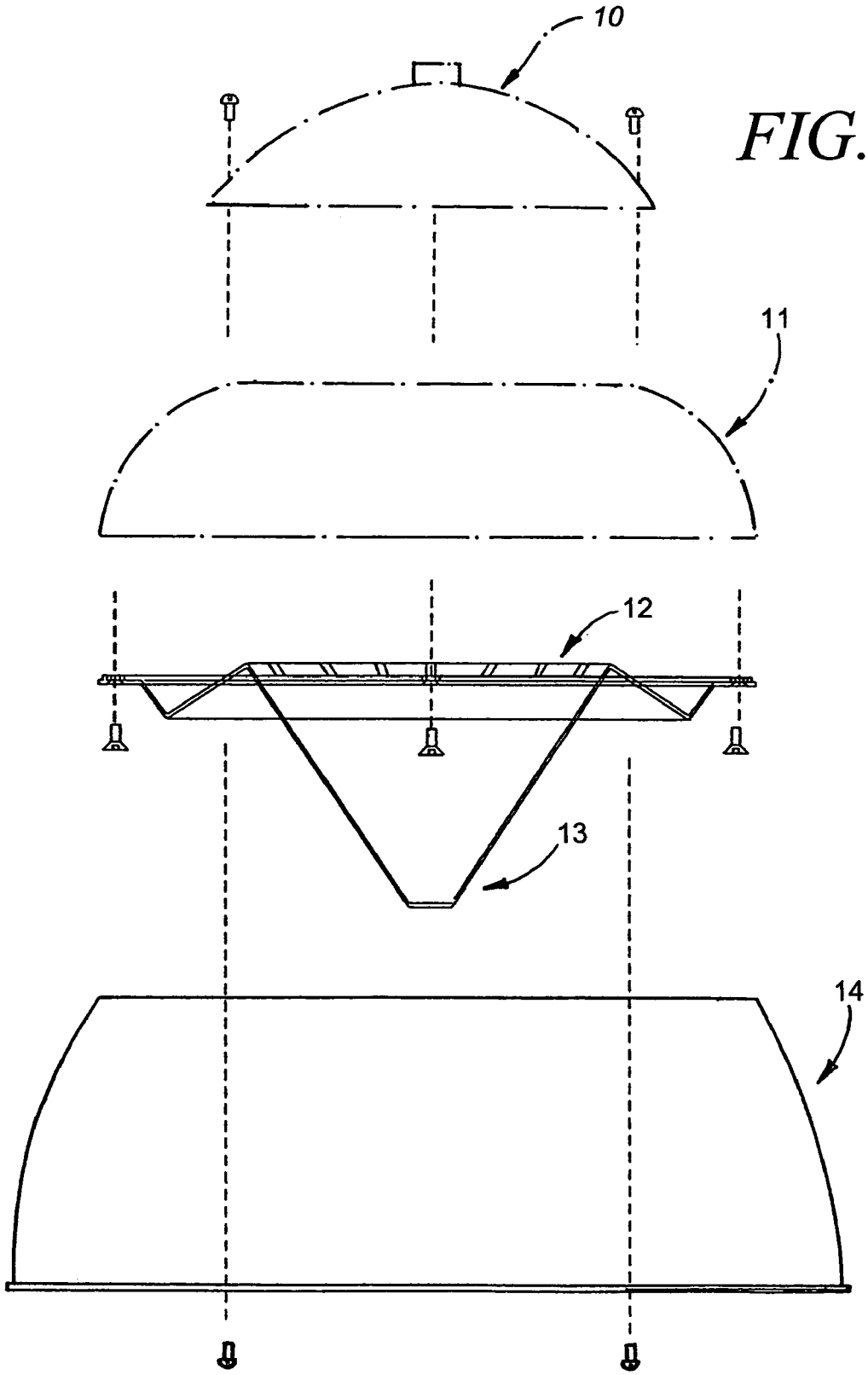
FIG. 14 is an exploded assembly view further illustrating the assembly of the top, the ballast support, the light support, the inner optic member, and the outer optic member of the lamp fixture of the invention.

Outer optic member 14 is illustrated in FIGS. 11 and 12 and includes flat circular upper edge 28 with apertures 28A formed therethrough to receive screws used to fasten member 14 to ballast support 11 so edge 28 is adjacent edge 41 in the manner illustrated in FIGS. 13 and 14. Member 14 also includes lower edge 26, outer arcuate surface 25, and inner concave arcuate optical surface 27. Substantially each point on surface 25 is equidistant from surface 27. Surface 27 can be finely polished to reflect light and radiant heat like a mirror, or, can be less finely polished or surfaced so that a smaller portion of light is reflected. Top 10, ballast support 11, light support 12, inner optic member 13, and outer optic member 14 can be made from an opaque material, from a translucent material, from a transparent material, or from any desired material. It is presently preferred that top 10, ballast support 11, light support 12 be fabricated from cast aluminum or another metal that functions to absorb heat and to conduct heat away from lights 16 mounted in the lamp fixture of the invention. Inner and outer optic members 13 and 14 can also, if desired, be fabricated from metal.

As earlier noted, FIGS. 13 and 14 illustrate the assembly of the components of the lamp fixture shown in FIGS. 1 to 12.

One particular advantage of the lamp fixture of the invention is that it enables the base and socket of each light 16 to be spaced farther apart from any adjacent light 16. In conventional lamp fixtures for compact fluorescent lights, the sockets are spaced one and a half to two inches apart. Spacing the sockets further apart is difficult because the lamp fixtures rapidly become too large and unsightly. The lamp fixture of the invention can readily space the light sockets four inches apart because the lights are tilted inwardly away from the inner optical concave surface 27 of the outer optic member.

Another particular advantage of the lamp fixture of the invention is that it more efficiently produces light because it utilizes an inner optic member 13 having a convex light reflecting surface 20.

A further advantage of the lamp fixture of the invention is that it more efficiently removes heat from the vicinity of each light 16. One reason for this is the ability, noted above, to space light sockets 17 farther apart, allowing a greater volume of heat sink material in light support 12 to absorb and conduct away heat. Another reason for this are the vents 60 formed in light support 12 above each opening 19 so heat travels upwardly over surface 81 into vents 60 (as indicated by arrow D in FIG. 13). Another reason for the improved heat dissipation quality of the lamp fixture is the formation of vents 61 in ridge 64. A portion of the heat produced out near the distal end of a light 16 rises upwardly into and through vents 61 (as indicated by arrow F) and is not trapped inside the light fixture. Sloped surfaces 81, 82 upwardly direct rising heat into and through vents 60. Sloped surface 80 directs heat downwardly and laterally (as indicated by arrow E) away from surface 71 into and through vents 61. Vents 42 formed in ballast support 11 also, as indicated by arrow G, facilitate the removal of heat from inside the lamp fixture. Vents 33 (as indicated by arrow H in FIG. 1) similarly facilitate the removal of heat.

Still another feature of the lamp fixture that facilitate heat removal is the flow or movement of air on either side of a ballast 15 panel installed in opposing pair 47—48 of wings 46. As indicated by arrow B in FIG. 13, some of the heated air rises upwardly past the front side 15A of a ballast 15 panel. On the other hand, arrow C indicates heated air rising upwardly past the back side of the ballast 15 panel. This occurs because the circular path or curvature of ridge 63 causes some of vents 60 to be on one side of ballast 15 and others of vents 60 to be on the other side of ballast 15. Vents 61 also direct heated air past ballast 15 in the manner indicated by arrow A in FIG. 13. Finally, heated air which rises into the space circumscribed by top 10 flows out through vents 31 and 32 in the manner indicated by arrows I and J in FIG. 13. The more efficient heat dissipation functioning of the lamp fixture of the invention enables larger wattage amalgam compact fluorescent lights to be used in the lamp fixture. For example, eight (8) fifty-seven watt amalgam compact fluorescent lights can be utilized in the light fixture illustrated in the drawings. The ability of the lamp fixture of the invention to house efficiently such large wattage compact fluorescent lights means that compact fluorescent lights, which are significantly more efficient than metal halide lights, can be used to light football fields, baseball fields, and other large areas for sporting and other events.

Still a further advantage of the lamp fixture of the invention is that a single housing contains both the compact fluorescent lights and the ballast necessary for the lights. Each ballast can operate one or more compact fluorescent lights.

Figure 3:
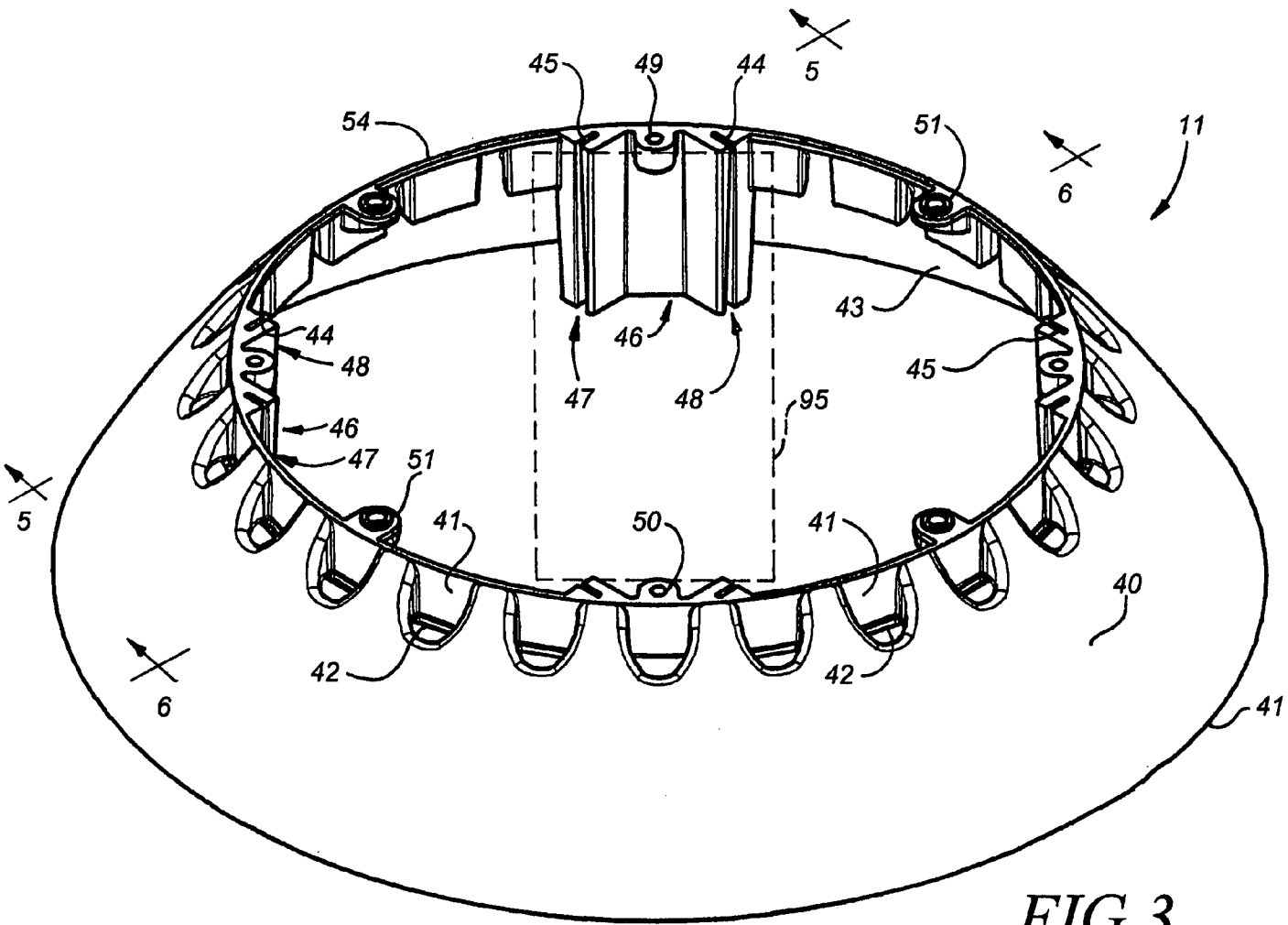
FIG. 3 is a top perspective view illustrating the ballast support of the lamp fixture of the invention.

Yet another advantage of the lamp fixture of the invention is that a single housing contains the compact fluorescent lights, the ballast for the lights, and the emergency ballast system. The emergency ballast system, including ballast and a battery, is indicated in FIG. 3 on support member 11 in FIG. 3 by dashed lines 95. A switch or other means for testing or activating the emergency ballast system (in the event electrical power is lost during a storm, etc.) can be mounted in opening 21A of inner optic member 13. A light fixture constructed in accordance with the invention need not, if desired, include an emergency ballast system.

Yet a further advantage of the lamp fixture of the invention is that the inward tilt of the compact fluorescent lights 16 enables the spacing between the sockets 17 to be increased without having to increase the diameter or size of the outer housing of the lamp fixture. In FIG. 17, each light 16 is tilted inwardly toward inner optic member 30 and centerline 90 and, consequently, is tilted away from outer optic member 14 and from the inner surface 27 of the outer optic member 14. The angle M between centerline 90 and the longitudinal axis 90A of a compact fluorescent light 16 installed in a socket 17 is in the range of forty degrees to eighty degrees, preferably fifty to seventy degrees, and most preferably thirty-five degrees to sixty-five degrees. In FIG. 17, axis 90A is parallel to the outer conical surface of member 30, but need not be. The angle, if any, between a light 16 and surface 20 can be adjusted as desired. The angle of the outer conical surface 20 of member 30 is canted with respect to axis 90 at an angle N that is in the range of twenty degrees to eighty degrees, preferably thirty degrees to seventy degrees, and most preferably forty degrees to sixty degrees. The majority of light from a light 16 that is downwardly reflected from the light fixture of the invention is reflected off surface 20 of member 30.

Having described the presently preferred embodiments and best mode of the invention in such terms as to enable those of skill in the art to understand and practice the invention,

We claim:

1. A lamp fixture including (a) a housing having
  (i) a base end of a first size,
  (ii) a light-emitting end of a second size larger than said first size,
  (iii) a center line extending from the center of the base end to the center of the light emitting end, and
  (iv) a concave outer optical surface extending intermediate said base end and said light-emitting end;

(b) a convex inner optical surface inside said housing extending around said center line; and, (c) a light support inside said housing for supporting a plurality of compact fluorescent lights displaced about said center line and said inner optical surface including a plurality of lamp supports angled such that compact fluorescent lights supported thereby extend inwardly toward said light-emitting end at an angle
  (i) toward said center line,
  (ii) toward said inner optical surface, and (iii) away from said concave inner surface of said housing.

2. A lamp fixture including (a) a dome-shaped housing having (i) a base end of a first size, (ii) a light-emitting end of a second size larger than said first size, (iii) a center line extending from the center of the base end to the center of the light emitting end, and (iv) an inner surface extending intermediate said base end and said light-emitting end;

(b) a light support inside said housing for supporting a plurality of compact fluorescent lights;

(c) ballast mounted inside said dome-shaped housing for each of the compact fluorescent lights; and, (d) an emergency ballast system mounted inside said dome-shaped housing and including a ballast and a battery.

3. A lamp fixture including (a) a dome-shaped housing having (i) a base end of a first size, (ii) a light-emitting end of a second size larger than said first size, (iii) a center line extending from the center of the base end to the center of the light emitting end, and (iv) an inner surface extending intermediate said base end and said light-emitting end;

(b) a light support inside said housing for supporting a plurality of compact fluorescent lights;

(c) ballast mounted inside said dome-shaped housing for each of the compact fluorescent lights; and, (d) first vents formed in the lamp fixture such that heat generated by the compact fluorescent lights rises upwardly through said vents past said ballast.

* * * * *